US007694895B2

(12) United States Patent
Bougamont et al.

(10) Patent No.: US 7,694,895 B2
(45) Date of Patent: Apr. 13, 2010

(54) PUSH-BUTTON SPRAYER EQUIPPED WITH A PROJECTING SIDE NOZZLE

(75) Inventors: Jean-Louis Bougamont, Eu (FR); Roger Didier Blondel, Criel sur Mer (FR)

(73) Assignee: Rexam Dispensing Systems S.A.S. (FR)

( * ) Notice: Subject to any disclaimer, the term of this patent is extended or adjusted under 35 U.S.C. 154(b) by 1189 days.

(21) Appl. No.: 11/102,293

(22) Filed: Apr. 8, 2005

(65) Prior Publication Data

US 2005/0236497 A1 Oct. 27, 2005

Related U.S. Application Data

(63) Continuation of application No. PCT/EP03/11200, filed on Oct. 9, 2003.

(30) Foreign Application Priority Data

Oct. 11, 2002 (FR) ..... 02 12691

(51) Int. Cl.
*A62C 13/62* (2006.01)
*B05B 1/34* (2006.01)

(52) U.S. Cl. ..... 239/302; 239/337; 239/490

(58) Field of Classification Search ..... 239/302, 239/321, 349, 461, 463, 597, 490, 337; 222/402.24, 222/402.1, 383, 333

See application file for complete search history.

(56) References Cited

U.S. PATENT DOCUMENTS

| | | | | |
|---|---|---|---|---|
| 2,111,852 | A | 3/1938 | Flinchbaugh | 141/215 |
| 2,729,367 | A | 1/1956 | Samuels | 222/402.25 |
| 3,503,559 | A | 3/1970 | Torretta | 239/573 |
| 3,589,562 | A * | 6/1971 | Buck | 222/649 |
| 4,991,750 | A | 2/1991 | Moral | 222/402.24 |
| 5,295,628 | A * | 3/1994 | Zuckschwerdt | 239/590.5 |
| 5,769,325 | A * | 6/1998 | Jouillat et al. | 239/337 |
| 5,769,326 | A * | 6/1998 | Muchenberger et al. | 239/428.5 |
| 6,505,759 | B2 * | 1/2003 | Holyfield | 222/180 |
| 6,732,958 | B2 * | 5/2004 | Norville et al. | 239/582.1 |

FOREIGN PATENT DOCUMENTS

DE 100 42 302 4/2004

OTHER PUBLICATIONS

International Search Report, Jan. 30, 2004, 3 pages.

* cited by examiner

*Primary Examiner*—Davis Hwu
(74) *Attorney, Agent, or Firm*—St. Onge Steward Johnston & Reens LLC

(57) ABSTRACT

The invention concerns a pump sprayer equipped with a projecting side nozzle. The nozzle is defined at the end of a rectilinear element attached to the pushbutton and said element is force-mounted in a cavity of the push-button, which is of sufficient depth to enable a depression of selected length, determining the length of the projecting part of said element.

10 Claims, 2 Drawing Sheets

PUSH-BUTTON SPRAYER EQUIPPED WITH A PROJECTING SIDE NOZZLE

This application is a continuation of International Patent Application No. PCT/EP2003/011200 filed Oct. 9, 2003 which designates the United States and claims priority of French Patent Application No. 0212691 filed Oct. 11, 2002.

FIELD OF THE INVENTION

The invention concerns a spray with plunger provided with a lateral spray nozzle projecting on the side of the button forming a plunger. It concerns more particularly an improvement aiming to make this type of device easily adaptable to its casing and less expensive to manufacture.

A type of spray is known comprising a bottle equipped with a pump with plunger, the latter comprising a lateral spray nozzle. The bottle is generally provided with a casing with an aesthetic nature representing the product to be sprayed. This casing comprises a cap completely covering the plunger. Conventionally, this plunger is fitted at the end of an output tube of a pump, itself fitted on the neck of the bottle. In the case of such a casing, the top of the cap is provided with a flexible membrane or similar element making it possible to operate the plunger. The latter is provided with a projecting lateral nozzle making it possible to take the spray orifice to the vicinity of the lateral wall of the cap. Said lateral wall comprises a slot extending parallel to the operating axis of the plunger and whose length corresponds to the operating travel of the pump. The nozzle is defined at the end of a straight, generally cylindrical, element. This element accommodates a core. The two pieces are made from a molded plastic material.

However, the length of this element depends on the bottle and its casing. Consequently, for a given type of bottle, it is necessary to produce two moulds, one for the straight element and the other for the core. This results in a high production cost. The invention proposes equipment adaptable to all configurations of bottle and casing.

Thus, the invention concerns a spray with pump equipped with a plunger provided with a projecting lateral nozzle, defined at the end of a straight element attached to said plunger and extending laterally with respect thereto, characterized in that said element is press-fitted into a cavity in said plunger communicating with the output of said pump, and in that said cavity has a depth suitable for allowing said element to be driven in by a chosen length, determining the length of the projecting part thereof.

The aforementioned straight element is provided with an end wall with a spray hole made therein. Said element defines an output channel for the liquid and contains the core mentioned above. One or more longitudinal passages are made between the internal surface of said output channel and the external surface of the core. A swirling chamber, known per se, is arranged between the internal orifice of the spray hole and one end of the core situated opposite this internal orifice. Consequently, the liquid supplied by the pump is discharged into the longitudinal passage or passages defined between the output channel and the core and sprayed at its output from the swirling chamber.

Advantageously, the aforementioned cavity is an overall cylindrical blind hole which extends perpendicular to an axial hole in the plunger into which the output tube of the pump is inserted. The blind hole communicates with the axial hole irrespective of the chosen position of the straight element inside said blind hole. To that end, said straight element can comprise, in its innermost part, at least one groove opening out at its internal end, capable of maintaining communication between the output channel of the straight element and the axial hole receiving the output tube of the pump. This groove makes it possible to maintain communication, even for a position where the element is inserted well into the blind hole.

According to another advantageous characteristic, the bottom of said blind hole comprises a limit stop formed by a discontinuity in alignment on which part of said internal end of the straight element comes to rest. This arrangement guarantees communication between said output channel and the output tube of the pump even when the aforementioned element is inserted as far as possible into the blind hole and comes into abutment against said limit stop.

As indicated previously, the machine for assembling the element (provided with its core) and the plunger is set up so as to determine the length by which said element projects laterally with respect to the lateral surface of said plunger. To that end, said element can comprise, at its external surface, notches or similar slight projections, for example annular ones, reinforcing said press-fitting.

BRIEF DESCRIPTION OF DRAWINGS

The invention will be better understood and other advantages thereof will emerge more clearly in the light of the following description of a spray with plunger in accordance with its principle, given solely by way of example and produced with reference to the accompanying drawings in which.

DETAILED DESCRIPTION OF DRAWINGS

Figure 1:
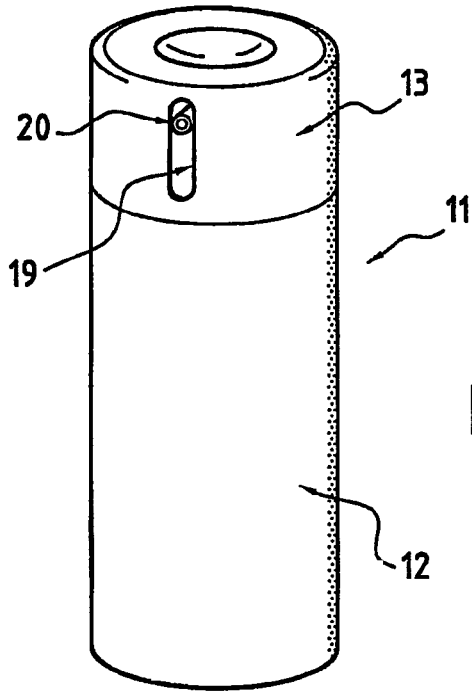
FIG. 1 is a general view in perspective of a spray bottle provided with its casing, to which the invention applies.
Figure 2:
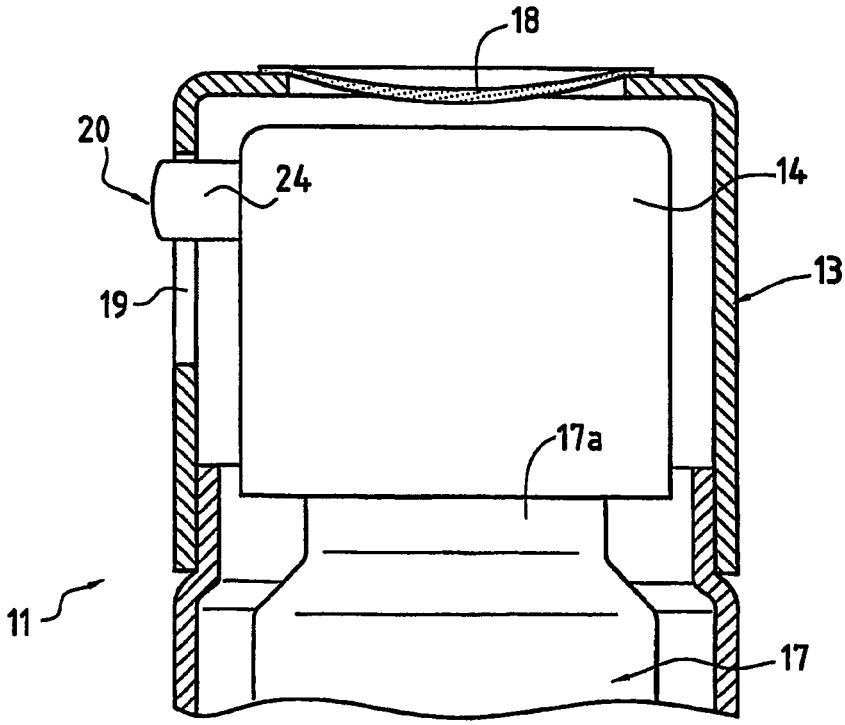
FIG. 2 is a detail view of FIG. 1, with a cross-section of the cap.

FIGS. 1 and 2 depict a spray 11 with manual pump entirely covered by a casing 12 with an aesthetic nature, here overall cylindrical. The lower part contains the bottle 17 whilst the upper part forms a kind of cap 13 completely covering the neck of the bottle and a plunger 14, which is fixed at the end of a manually operated pump fitted in the neck of the bottle. FIG. 2 shows more particularly the neck 17*a* of the bottle 17 and the plunger 14 whose upper end is placed opposite and at a short distance from a flexible membrane 18 hiding a window made in the upper face of the cap 13.

In this type of spray, it is necessary to laterally take the spray nozzle as far as a slot 19 formed in the lateral wall of the cap 13 parallel to the operating axis of the pump. To that end, the spray nozzle 20 is defined at the end of a straight element 24 inside which an output channel 25 for the liquid is defined. This element is attached to the plunger and extends laterally with respect thereto. Its end is inserted into the slot 19 in the cap, so that the spraying takes place entirely outside thereof. The end of the element 24 lies flush with the lateral surface of the cap 13.

It emerges from the above that the length by which the straight element projects beyond the plunger depends on several factors, in particular the size of the bottle, the shape and dimensions of the cap, etc. The invention makes it possible to use a straight element 24 of a single length, capable of adapting to all configurations. To that end, the plunger, visible in cross-section in FIG. 3, comprises a cavity 28 with a section corresponding to that of the element, which is press-fitted into this cavity. In the example, the element 24 and the cavity 28 are cylindrical.

Figure 3:
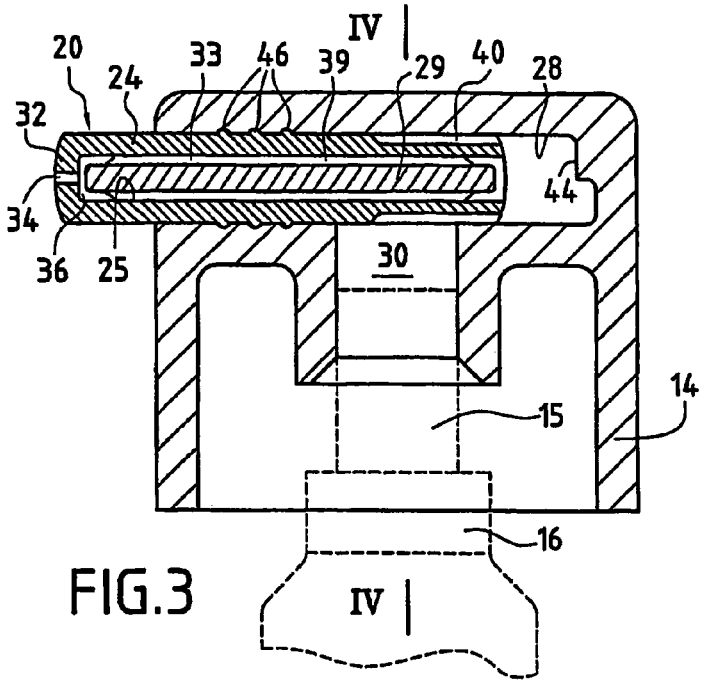
FIG. 3 is a detail view in elevation and cross-section showing the spray nozzle, the plunger and the pump.
Figure 4:
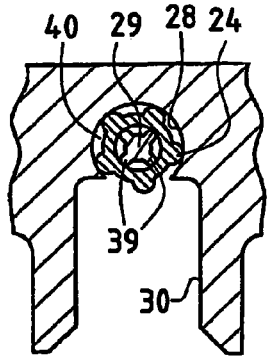
FIG. 4 is a section IV-IV of FIG. 3.

As seen in FIG. 3, the cavity 28 has a sufficient depth, suitable for allowing the element 24 to be driven in by a chosen length, which determines the length of the projecting part thereof, this length being determined at the setup of the machine for assembling the plunger 14 and the element 24, which contains a core 29.

The plunger 14 communicates with the output of the pump 16 which is associated therewith. FIG. 3 depicts the output tube 15 of this pump and it can be seen that, conventionally, the plunger 14 comprises a hole 30, here extending axially, into which the output tube 15 of the pump is inserted. The cavity 28 for fitting the element 24 communicates with this axial hole 30 and consequently with the output of the pump. In the example, the element 24 being overall cylindrical, the cavity is an overall cylindrical blind hole of corresponding diameter. It extends perpendicular to the axial hole and communicates therewith.

Said element 24 is provided with an end wall 32 with a spray hole 34 made therein. One or more longitudinal passages 33 are formed between the internal surface of the output channel 25 and the external surface of the core 29. This allows the liquid discharged by the pump to reach as far as a swirling chamber 36, known per se, arranged between the internal orifice of the spray hole 34 and one end of the core 29 situated opposite this internal orifice. This swirling chamber, into which the liquid is introduced substantially tangentially, generates a very highly turbulent flow of the liquid and its expulsion from the spray hole 34 in the form of fine droplets. In the example depicted, several longitudinal passages 33 have been defined in the element 24, created by longitudinal ribs 39 defined on the external surface of the core 29 and in contact with the internal surface of said output channel 25. The core 29 is inserted and press-fitted into this channel. It extends over practically the entire length thereof in order to minimize the amount of liquid product stagnating beyond the output of the pump.

Advantageously, the core 29 is shaped in the same way at each end, in order to make its orientation unnecessary upon fitting in the element. Consequently, in the example described, each end of the core comprises a reduction in diameter suitable for defining, with the internal wall of the output channel, a small annular cavity feeding the swirling chamber.

Figure 5:
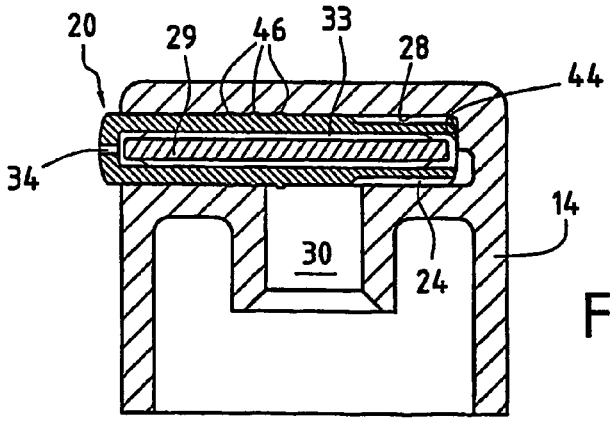
FIGS. 5 and 6 are views similar to FIG. 3, on a smaller scale, showing different fitting configurations adapted to respective casings, not depicted.
Figure 6:
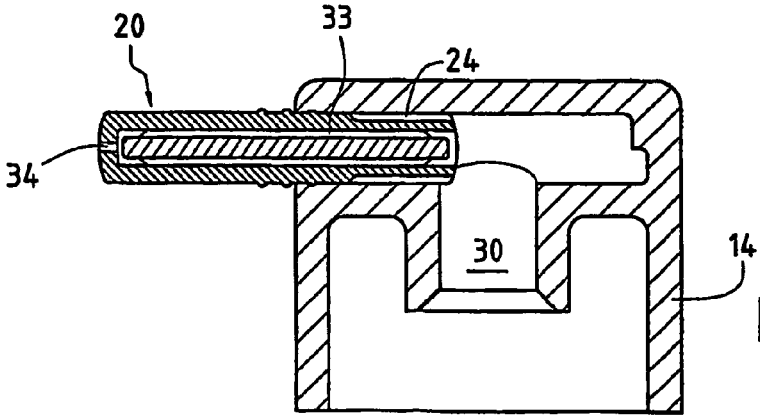

The blind hole, defined in the plunger 14, extends diametrically either side of the axial hole 30 by which the plunger is fitted at the end of the output tube 15 of the pump. The element comprises, in its innermost part, at least one groove 40 opening out at its internal end, capable of maintaining communication between the output channel 25 of the straight element (as far as the spray hole) and the axial hole 30 receiving the output tube of the pump, for any position of the element in the blind hole, even if said element is inserted well into the blind hole, as depicted in FIGS. 3 and 5.

In the example described, several grooves 40 are defined at the periphery of the element 24. For any position of the element in the plunger, there exists a sealed cylindrical clamping area defined between the cylindrical part of the element 24 and the internal surface of the blind hole and a clamping area on the grooved part defined by the presence of the grooves 40, the external diameter of this part being the same as that of the adjacent smooth part.

According to another advantageous characteristic, the bottom of the blind hole comprises a limit stop 44 formed by a discontinuity in alignment defined laterally with respect to the axis of said blind hole. The internal end of the element 24 comes into abutment on this limit stop when it is inserted as far as possible into the blind hole. In this way, as can be seen in FIG. 5, the communication between the pump output and the spray hole is not interrupted, even in this position.

Advantageously, the element 24 comprises, at its external surface, notches 46, here with an annular configuration reinforcing the press-fitting. These notches are squeezed during the press-fitting of the element 24 into the cavity 28.

What is claimed is:

1. A sprayer comprising:

a pump equipped with a plunger, said plunger having a cavity communicating with the output of said pump;

a cap covering said plunger, said cap comprising a lateral wall having a slot formed therein, said plunger being longitudinally actuatable with respect to said cap;

a straight element attached to said plunger by being press-fitted into the cavity, the element extending laterally with respect to said plunger and defining a projecting lateral nozzle at an end thereof;

wherein the cavity in said plunger has a depth suitable for allowing said element to be inserted therein by a chosen length so as to vary an extent to which the nozzle protrudes from said plunger;

wherein the element is inserted into the cavity in said plunger to a depth such that the nozzle extends into the slot formed in the lateral wall of said cap; and wherein the end of said element defining the nozzle moves longitudinally within the slot as said plunger is actuated with respect to said cap.

2. A sprayer according to claim 1, characterized in that said element defines an output channel provided with an end wall with a spray hole made therein.

3. A sprayer according to claim 2, characterized in that said cavity is an overall cylindrical blind hole, in that said cavity extends perpendicular to a hole into which an output tube of said pump is inserted, and in that said cavity communicates with said hole.

4. A sprayer according to claim 2, characterized in that said output channel contains a core, in that one or more longitudinal passages are made between the internal surface of said output channel and the external surface of said core, and in that a swirling chamber is arranged between the internal orifice of said spray hole and one end of said core situated opposite the internal orifice.

5. A sprayer according to claim 4, characterized in that the one or more longitudinal passages are created by longitudinal ribs defined on the external surface of said core, in contact with the internal surface of said output channel.

6. A sprayer according to claim 4, characterized in that said core is shaped in the same way at each end, in order to make orientation of said core unnecessary upon fitting.

7. A sprayer according to claim 3, characterized in that said blind hole extends diametrically on either side of said hole, and in that said straight element comprises, in an innermost part thereof, at least one groove opening out at an internal end, capable of maintaining communication between said output channel of said straight element and said hole receiving the output tube of the pump, for a position where said element is inserted well into said blind hole.

8. A sprayer according to claim 7, characterized in that several grooves are defined at the periphery of said element.

9. A sprayer according to claim 7, characterized in that the bottom of said blind hole comprises a limit stop formed by a discontinuity in alignment, on which said internal end of said straight element comes to rest in part in a position where said element is inserted as far as possible into said blind hole.

10. A sprayer according to claim 1, characterized in that said element comprises, at its external surface, notches reinforcing said press-fitting.

* * * * *